US010569289B2

(12) United States Patent
Okada et al.

(10) Patent No.: US 10,569,289 B2
(45) Date of Patent: Feb. 25, 2020

(54) APPLICATION APPARATUS

(71) Applicant: TOYO SEIKAN CO., LTD., Shinagawa-ku, Tokyo (JP)

(72) Inventors: Yoshiaki Okada, Yokohama (JP); Keisuke Nyuu, Yokohama (JP); Tomoyuki Miyazaki, Yokohama (JP); Yoshitsugu Kawai, Yokohama (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 0 days.

(21) Appl. No.: 15/938,620

(22) Filed: Mar. 28, 2018

(65) Prior Publication Data

US 2018/0214900 A1 Aug. 2, 2018

Related U.S. Application Data

(63) Continuation of application No. 15/252,660, filed on Aug. 31, 2016, now Pat. No. 9,956,566, which is a (Continued)

(30) Foreign Application Priority Data

Apr. 21, 2014 (JP) ..... 2014-087331

(51) Int. Cl.
*B05B 13/06* (2006.01)
*B05B 14/00* (2018.01)
(Continued)

(52) U.S. Cl.
CPC ..... *B05B 13/0636* (2013.01); *B05B 7/0416* (2013.01); *B05B 13/069* (2013.01); (Continued)

(58) Field of Classification Search
CPC ..... B05B 3/023; B05B 3/025–027; B05B 3/1035; B05B 3/1042; B05B 3/1064; (Continued)

(56) References Cited

U.S. PATENT DOCUMENTS 2,336,946 A * 12/1943 Marden ..... B05B 3/1021 118/308
3,734,407 A 5/1973 De Stefano, Jr.
(Continued)

FOREIGN PATENT DOCUMENTS

DE 199 10 293 A1 1/2001
EP 0 338 222 A2 10/1989
(Continued)

OTHER PUBLICATIONS

International Search Report dated Apr. 21, 2015, issued in counterpart international application No. PCT/JP2015/051518 (2 pages).
(Continued)

*Primary Examiner* — Cody J Lieuwen
(74) *Attorney, Agent, or Firm* — Westerman, Hattori, Daniels & Adrian, LLP

(57) ABSTRACT

A coating material is uniformly applied on an inner wall surface of a container while preventing leakage of the coating material and an increase in an installation space. An application apparatus (10) that applies a coating material (L) on an inner wall surface of a container (C) includes: a spray gun (20) having a spray nozzle (22); an outgoing pipe (30) and a return pipe (33); a supply controller (50); a rotary driver (60); and a mover (70), wherein the outgoing pipe (30) and the return pipe (33) are each provided with a resilient-shape part (32, 35) capable of extending and contracting resiliently.

11 Claims, 5 Drawing Sheets

Related U.S. Application Data continuation of application No. PCT/JP2015/051518, filed on Jan. 21, 2015.

(51) Int. Cl.
*B05B 15/58* (2018.01)
*B05B 7/04* (2006.01)
*B05B 13/02* (2006.01)

(52) U.S. Cl.
CPC ..... *B05B 14/00* (2018.02); *B05B 15/58* (2018.02); *B05B 13/0278* (2013.01)

(58) Field of Classification Search
CPC ..... B05B 3/12; B05B 3/18; B05B 13/0278; B05B 13/041; B05B 13/0415; B05B 13/0421; B05B 13/0473; B05B 13/0478; B05B 13/0484; B05B 13/0627; B05B 13/0636; B05B 13/069; B05B 15/0406; B05B 15/0425; B05B 15/067; B05B 15/068; B05B 7/02; B05B 1/28; B05B 7/0416; B05B 15/58; B05B 14/00; B05C 5/002; B05C 5/0208; B05C 11/10; B05C 11/1039; Y10S 118/03
USPC ..... 239/227, 263, 263.3, 104, 112, 113, 119, 239/124, 127, 11; 118/DIG. 3
See application file for complete search history.

(56) References Cited

U.S. PATENT DOCUMENTS 3,921,570 A 11/1975 Hogstrom et al.
4,170,192 A * 10/1979 Maddock ..... B05B 3/02 118/306
5,038,708 A * 8/1991 Wells ..... B05B 13/0627 118/313
5,141,165 A * 8/1992 Sharpless ..... B05B 13/0431 239/752
5,755,844 A 5/1998 Arai et al.
5,755,884 A 5/1998 Buckler et al.
2003/0052189 A1* 3/2003 Kronz ..... B05B 15/68 239/227
2004/0011886 A1* 1/2004 Lawson ..... A47L 9/244 239/302
2014/0314952 A1* 10/2014 Chism ..... B05B 9/0406 427/236

FOREIGN PATENT DOCUMENTS

EP 0 385 755 A1 9/1990
EP 0 562 888 A1 9/1993
EP 0 578 426 A2 1/1994
GB 642777 A 9/1950
JP 57-17760 B1 6/1980
JP 61-242655 A 10/1986
JP 63-58661 U 4/1988
JP 10-230200 A 9/1998
JP 2001-224988 A 8/2001
JP 2007-000845 A 1/2007
JP 2007000845 A * 1/2007
JP 2011-230075 A 11/2011
JP 2012-134289 A 7/2012
JP 2013-212475 A 10/2013
WO 89/06757 A1 7/1989
WO 2012/151087 A1 11/2012

OTHER PUBLICATIONS

Search Report dated Nov. 20, 2017, issued in counterpart European Application No. 15783031.6 (10 pages).
Extended European Search Report dated Sep. 10, 2018, issued in counterpart European Application No. 18170746.4. (11 pages).

* cited by examiner

APPLICATION APPARATUS

CROSS-REFERENCE TO RELATED APPLICATIONS

This application is a continuation of U.S. application Ser. No. 15/252,660, filed on Aug. 31, 2016, which is a Continuation of International Application No. PCT/JP2015/051518 filed on Jan. 21, 2015, which is based upon and claims the benefit of priority from the prior Japanese Patent Application No. 2014-087331, filed on Apr. 21, 2014, the entire contents of which are incorporated herein by reference.

TECHNICAL FIELD

The present invention relates to an application apparatus that applies a coating material on an inner wall surface of a container, and more particularly to an application apparatus that applies a coating material that improves slipperiness on the inner wall surface of the container.

BACKGROUND ART

In general, plastic containers are widely used for various purposes because of good formability and low production cost. One problem with such plastic containers was that when the containers contain a viscous material such as mayonnaise-like food products, it is hard to use up all the contents as the material tends to stick to the inner wall surface of the container. In this respect, coating materials that improve the ability of the contained material to slide down have been developed recently, and it has been known that with such a coating material being applied on the inner wall surface of the container, the contents in the container can easily be used up due to the improved ability to slide down the inner wall surface of the container.

In order for such a coating material to favorably exhibit its properties, it is necessary to apply the coating material uniformly on the inner wall surface of the container. However, plastic containers come in various shapes and have a small opening diameter, and with the use of a spray gun (see, for example, PTL 1) commonly used in an application apparatus, it was difficult to apply the coating material uniformly on the inner wall surface of the container.

As one method of applying the coating material uniformly on the inner wall surface of the container, the spray gun could be inserted in the container, and a spray of coating material could be ejected while the spray gun is rotated and moved up and down or back and forth. Alternatively, with the spray gun inserted in the container, the container could be rotated instead of the spray gun, and the coating material could be ejected while the spray gun is moved up and down or back and forth.

CITATION LIST

Patent Literature

[PTL1] Japanese Patent Application Laid-open No. 2001-224988

SUMMARY OF INVENTION

Technical Problem

In the spray gun described in PTL 1 in which the coating material is circulated, if the coating material were to be ejected while the spray gun is rotated and moved back and forth, the connecting part between the pipe that forms a coating material circulatory path and the spray gun would be subjected to stress. Namely, in a spray gun wherein the coating material is circulated as in the one described in PTL 1, a pipe is connected to the spray gun for circulation of the coating material, and the coating material circulating through the coating material circulatory path is supplied into a coating material ejection passage connecting to the spray nozzle to be ejected from the spray nozzle. By thus circulating the coating material, settling and the like of the coating material is prevented. In such a circulation type spray gun, if the spray gun were rotated as well as moved back and forth, the pipe would wind around the spray gun, bringing about the problem of the connecting part between the pipe and the spray gun being subjected to stress.

One measure to solve this problem that arises if the spray gun were rotated would be to connect the pipe to the spray gun such as to be rotatable relative to the spray gun. In this case, however, the connecting structure between the pipe and the spray gun would become complex and another problem arises, which is that it would be difficult to prevent leakage of coating material from the connecting part.

Another measure to solve the problem that arises if the spray gun were rotated would be to make the pipe sufficiently long. In this case, however, the pipe would take up much space in the lateral direction outside the spray gun in the initial state of the application apparatus, leading to another problem in that the application apparatus would require a larger installation space.

Yet another measure to solve the problem that arises if the spray gun were rotated would be to make the pipe using a soft, highly elastic material so that the pipe can stretch by elastic deformation when the spray gun is rotated and moved back and forth. In this case, however, there is a problem in that it would be difficult to ensure sufficient strength for such a soft and highly elastic pipe to withstand the pressure of the coating material flowing through the coating material circulatory path.

On the other hand, if the container were to be rotated instead of the spray gun, it would be hard to provide a secure hold while rotating the container since plastic containers come in various shapes and sizes.

Accordingly, the present invention is directed to solve these problems, and an object thereof is to provide an application apparatus capable of applying a coating material uniformly on an inner wall surface of a container with a simple structure while preventing leakage of the coating material and an increase in the installation space.

Solution to Problem

The present invention provides an application apparatus that applies a coating material on an inner wall surface of a container, including: a spray gun having a spray nozzle and including a coating material ejection passage formed therein; an outgoing pipe and a return pipe attached to said spray gun and forming a coating material circulatory path connecting to said coating material ejection passage; a supply controller that controls supply of the coating material from said coating material circulatory path to said coating material ejection passage; a rotary driver that rotates said spray gun around an axis extending along a longitudinal direction of the gun; and a mover that moves said spray gun along the longitudinal direction of the gun, wherein said spray gun includes, formed therein, said coating material ejection passage connecting to said spray nozzle, and a coating material passage connecting to said coating material ejection passage; said outgoing pipe and said return pipe each have one end attached to an outer circumferential part of said spray gun that is rotatable so as to connect directly with said coating material passage, and form said coating material circulatory path together with said coating material passage; said supply controller includes an open/close valve provided between said coating material passage and said coating material ejection passage and is configured to supply the coating material from said coating material passage to said coating material ejection passage by opening and closing said valve; said outgoing pipe and said return pipe are each provided with a coil-like resilient-shape part capable of extending and contracting resiliently; and said coil-like resilient-shape parts of said outgoing pipe and said return pipe are disposed outside said spray gun so as not to surround said spray gun that is rotatable, whereby the problems described above are solved.

Advantageous Effects of Invention

According to the invention, the outgoing pipe and the return pipe attached to the spray gun are each provided with a resilient-shape part capable of extending and contracting resiliently, so that, when the spray gun is rotated, and moved up and down or back and forth, the resilient-shape part extends and prevents too much stress from being applied to a connecting part between each pipe and the spray gun, while preventing the pipes from taking up much space in the lateral direction and thus avoiding an increase in the required installation space.

Since the resilient-shape part has a shape that allows it to extend and contract resiliently, even if the pipes are made from a material that has a strength high enough to withstand the pressure of the coating material flowing through the coating material circulatory path, each pipe can be imparted with the ability to extend and contract.

Moreover, the configuration in which the spray gun is rotated and not the containers obviates the need to install a container rotation device in the existing production line, as well as enables efficient application of coating material within a limited space of the production line, so that facility investment costs can be kept low.

According to the invention, the resilient-shape part provided to the outgoing pipe and the return pipe is formed in a coil shape. Since the resilient-shape part can be contracted into a compact shape, it requires less installation space. Also, the cross-sectional shape of the pipe can easily be maintained constant even when the resilient-shape part undergoes resilient deformation, so that smooth flow of the coating material can be maintained.

According to the invention, the rotary driver rotates the spray gun through a predetermined angle in forward and reverse directions. Since the degree to which each pipe winds around the spray gun can be mitigated by rotating the spray gun in various combinations of forward and reverse directions, the connecting part between each pipe and the spray gun can be prevented from being subjected to too much stress.

According to the invention, the rotary driver rotates the spray gun 180° to 360°. Since the coating material can be applied to the entire inner wall surface of the container irrespective of the nozzle shape of the spray nozzle, the degree of design freedom of the nozzle shape is increased.

According to the invention, the spray nozzle has a nozzle shape capable of ejecting the coating material such as to spread symmetrically on both right and left sides. For applying the coating material on the entire inner wall surface of the container, the rotation angle of the spray nozzle rotated by the rotary driver can be set to 180°, so that the rotary driver can be configured simply and at low cost.

According to the invention, the spray gun is disposed such that the longitudinal direction of the gun coincides with an up-and-down direction. Since the application apparatus can be readily incorporated in an existing production line that conveys containers to which coating material is to be applied in a horizontal direction, the facility investment costs can be kept low.

According to the invention, the supply controller includes an air ejector that supplies air to the spray gun to allow the coating material to be supplied from the coating material circulatory path to the coating material ejection passage, and the rotary driver and the mover each include a pneumatic actuator. Since the same air supply source can be shared by using the air as the drive medium of various means, the facility investment costs can be reduced.

According to the invention, a gear is interposed between a rotary actuator of the rotary driver and the spray gun, so that the rotation angle of the spray gun can be easily adjusted by changing the gear ratio.

According to the invention, the apparatus further includes an aspirator that can be positioned opposite a container opening. Since the coating material that has been ejected from the spray nozzle and atomized inside the container can be sucked through the container opening, the atomized coating material is prevented from adhering to the upper end edge of the container opening, spray nozzle, or unintended places such as the outer environment, and also the coating material can be applied uniformly on the inner wall surface of the container.

According to the invention, the aspirator is configured as an airflow augmentation unit, and the airflow augmentation unit includes an airflow augmenting passage having a gas supply part, a suction port, and an ejection port, the suction port being disposed opposite the container opening. Since the atomized coating material can be sucked out from the suction port in a favorable manner with the use of the compressed gas, the apparatus does not require bulky equipment such as a vacuum system and can be made simpler with a smaller installation space.

According to the invention, the airflow augmentation unit is disposed such that a shaft of the spray gun is positioned inside the airflow augmenting passage. Since the suction port of the airflow augmentation unit can cover the entire container opening, the atomized coating material can be sucked reliably.

According to the invention, the apparatus further includes second mover that moves the airflow augmentation unit along the longitudinal direction of the gun, so that the suction port can be brought closer to the container opening to ensure that the atomized coating material is sucked, and also the application apparatus can be readily incorporated into an existing production line.

REFERENCE SIGNS LIST

Figure 1:
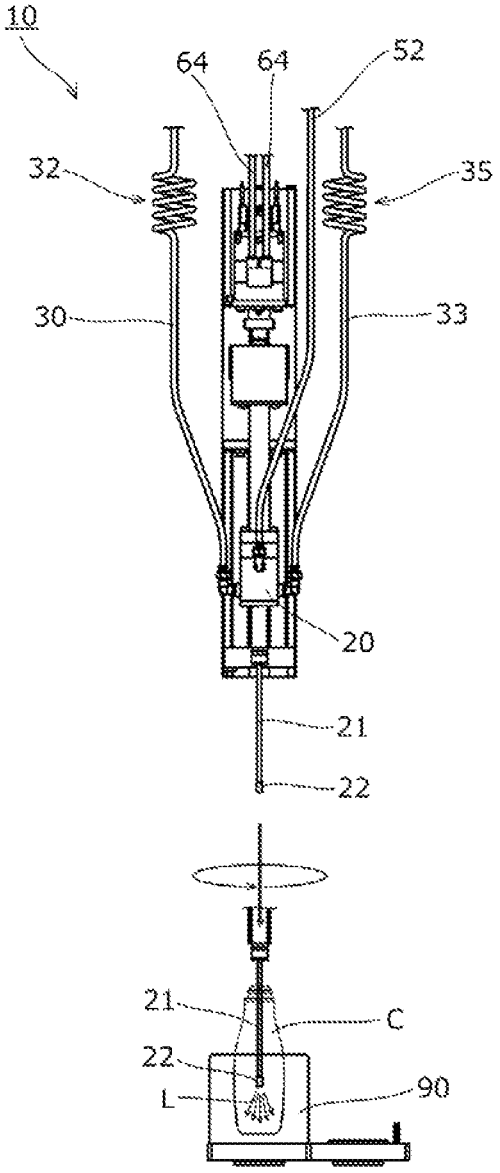
FIG. 1 is a front view illustrating an application apparatus according to a first embodiment of the present invention.

10 Application apparatus
20 Spray gun
21 Shaft
22 Spray nozzle
23 Coating material ejection passage
24 Coating material passage
30 Outgoing pipe
31 Coating material passage
32 Resilient-shape part
33 Return pipe
34 Coating material passage
35 Resilient-shape part
40 Coating material circulatory path
50 Supply controller
51 Valve
52 Air supply pipe (air ejector)
60 Rotary driver
61 Rotary actuator
62 First gear
63 Second gear
64 Rotary actuator air supply pipe
70 Mover
71 Base
72 Linear guide
73 Slider
80 Rotary support
81 Bearing
90 Container holding unit
100 Airflow augmentation unit (aspirator)
101 Airflow augmenting passage
102 Gas supply part
103 Suction port
104 Ejection port
105 Gas supply pipe
110 Second mover
111 Second linear guide
112 Second slider
C Container
C1 Container opening
L Coating material

DESCRIPTION OF EMBODIMENTS

Hereinafter, an application apparatus 10 according to a first embodiment of the present invention will be described with reference to the drawings.

Figure 2:
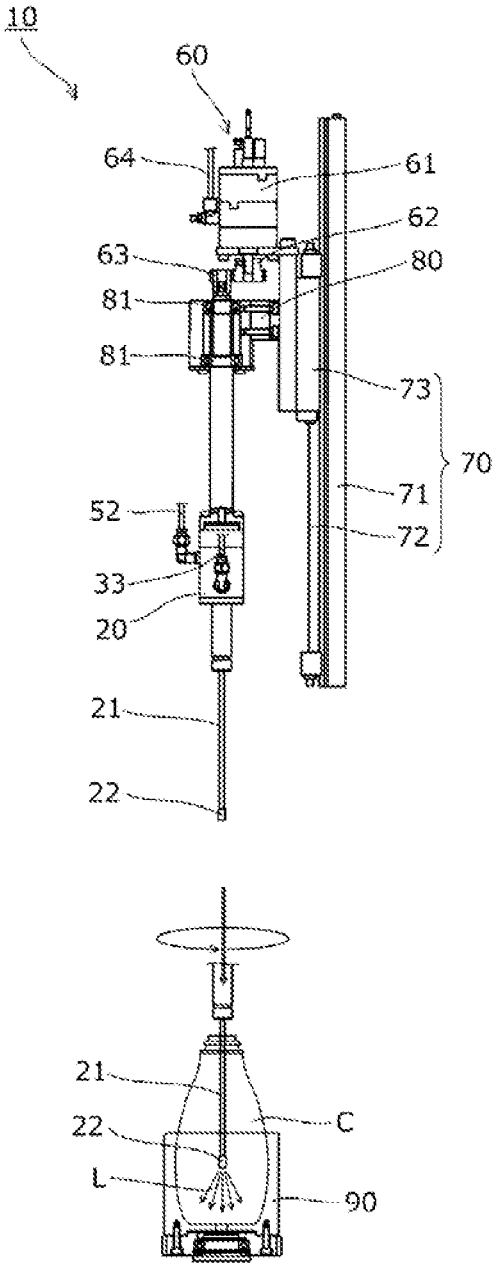
FIG. 2 is a side view illustrating the application apparatus.

The application apparatus 10 applies a coating material L that improves surface slipperiness for the contents of a container on an inner wall surface of the container C, which is for containing a viscous material such as mayonnaise-like food products, by ejecting the coating material L inside the container C from a spray nozzle 22 that is inserted into the container C while the spray gun 20 is rotated, as shown in FIG. 1 and FIG. 2.

Figure 3:
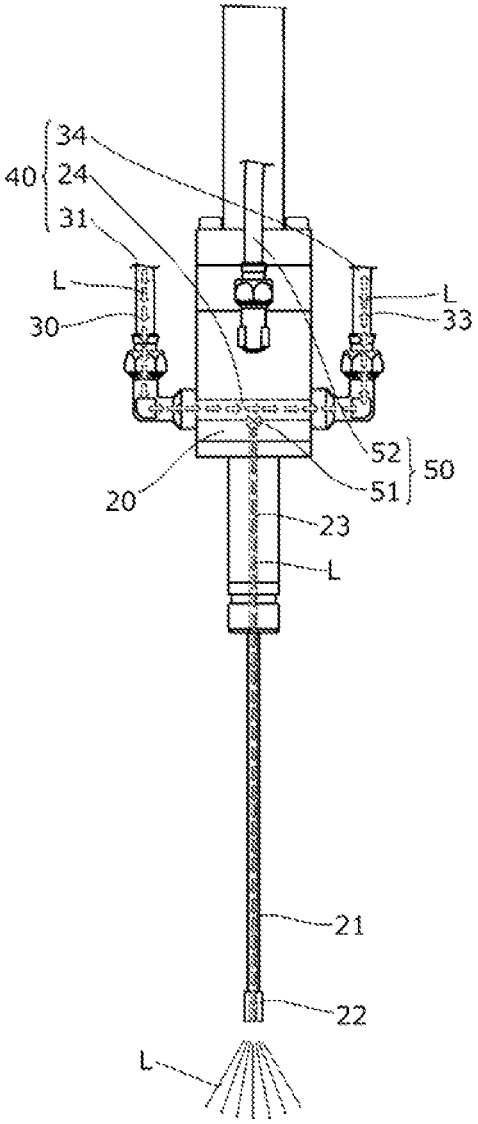
FIG. 3 is an illustrative diagram showing the flow of coating material.

The application apparatus 10 includes, as shown in FIG. 1 to FIG. 3, the spray gun 20 having a coating material ejection passage 23, an outgoing pipe 30 and a return pipe 33 attached to the spray gun 20 and forming part of a coating material circulatory path 40, a supply controller 50 that controls supply of the coating material L from the coating material circulatory path 40 to the coating material ejection passage 23, rotary driver 60 that rotates the spray gun 20 around an axis extending along the longitudinal direction of the gun, a mover 70 that move the spray gun 20 along the longitudinal direction of the gun, a rotatable support 80 having a bearing 81 that rotatably supports the spray gun 20, and a container holding unit 90 that holds the container C.

Below, each of the constituent elements of the application apparatus 10 will be described with reference to FIG. 1 to FIG. 3.

First, the spray gun 20 for ejecting the coating material L includes a shaft 21 that is thin enough to be inserted into the container C, and the spray nozzle 22 provided at the tip of the shaft 21, as shown in FIG. 1 to FIG. 3. The spray nozzle 22 may have any shape as long as it sprays the coating material L in a spreading manner, preferably such that the coating material L spreads symmetrically on both right and left sides. In this embodiment, one spray nozzle 22 is provided at the tip of the shaft 21, but any number of spray nozzles 22 can be provided anywhere. The spray nozzle 22 may have an air jet orifice so as to atomize the coating material L ejected from the spray nozzle 22.

Inside the spray gun 20 are formed the coating material ejection passage 23 connecting to the spray nozzle 22, and a coating material passage 24 connecting to this coating material ejection passage 23, as shown in FIG. 3. This coating material passage 24 forms part of the coating material circulatory path 40 for circulating the coating material L, together with a coating material passage 31 inside the outgoing pipe 30 and a coating material passage 34 inside the return pipe 33.

The outgoing pipe 30 and return pipe 33 are disposed outside the spray gun 20 as shown in FIG. 1, and each have one end attached to the spray gun 20 and the other end attached to a tank (not shown) that stores the coating material L. The outgoing pipe 30 and return pipe 33 are made of a hard synthetic resin such as high-density polyethylene so as to be able to withstand the pressure of the coating material L circulating through the coating material passages 31 and 34 formed inside. The outgoing pipe 30 and return pipe 33 are transparent or translucent so that the state of the coating material L (settling, etc.) can be checked from outside. Coil-like resilient-shape parts 32 and 35 are formed to the outgoing pipe 30 and return pipe 33 as shown in FIG. 1. The resilient-shape parts 32 and 35 are not specifically limited to the coil-like shape and they may have any shape as long as they include a plurality of bent or curved parts and can resiliently extend and contract.

The supply controller 50 includes, as can be seen from FIG. 3, an open/close valve 51 provided between the coating material ejection passage 23 and the coating material circulatory path 40, an air supply pipe 52 that forms an air ejector for supplying air to open and close this valve 51, and an air supply source (not shown) connected to the air supply pipe 52. Supplying the air through the air supply pipe 52 to the spray gun 20 opens the valve 51, so that the coating material L is supplied from the coating material circulatory path 40 to the coating material ejection passage 23, with the use of the pressure of the coating material L inside the coating material circulatory path 40. In this way, in this embodiment, the timing and amount of ejecting the coating material L from the spray nozzle 22 are controlled by adjusting the timing and duration of the air supply.

The air supply pipe 52 should preferably have a resilient-shape part similar to the resilient-shape parts 32 and 35 of the outgoing pipe 30 and return pipe 33 described above.

The supply controller 50 may have any other specific forms as long as the supply of the coating material L from the coating material circulatory path 40 to the coating material ejection passage 23 is controlled. The drive source of the supply controller 50 may also be any type other than the one that uses air as described above, such as an electrical drive source.

The rotary driver 60 includes, as shown in FIG. 2, a rotary actuator 61, and a first gear 62 and a second gear 63 disposed between the rotary actuator 61 and the spray gun 20. The first gear 62 is fixed to an output shaft of the rotary actuator 61, while the second gear 63 is fixed to the rear end of the spray gun 20, so that the rotary drive force of the rotary actuator 61 is transmitted to the spray gun 20 with a predetermined gear ratio by these first gear 62 and second gear 63. The rotary actuator 61 is a pneumatic rotary actuator 61 that uses air as the drive medium and connected to an air supply source (not shown) by a rotary actuator air supply pipe 64.

The rotary actuator air supply pipe 64 should preferably have a resilient-shape part similar to the resilient-shape parts 32 and 35 of the outgoing pipe 30 and return pipe 33 described above.

The rotary driver 60 may have any specific form as long as the spray gun 20 is rotated around an axis extending along the longitudinal direction of the gun, i.e., in the illustrated example, along the up-and-down direction. The drive source of the rotary driver 60 may also be any type other than the one that uses air as described above, such as an electrical drive source. While the rotary driver 60 in this embodiment is configured to rotate the spray gun 20 360° in forward and reverse directions, the rotation angle of the spray gun 20 rotated by the rotary driver 60 may be set otherwise as long as it is 180° or more.

For example, if the spray gun 20 is rotated 360° in forward and reverse directions, the spray nozzle 22 may be provided with one ejection port, and if the spray gun 20 is rotated 180° in forward and reverse directions, the spray nozzle 22 may be provided with ejection ports at two symmetrical positions.

The mover 70 is configured as a pneumatic rodless cylinder as shown in FIG. 2 and include a base 71 having a linear guide 72, and a slider 73 movable along the up-and-down direction. An air supply source (not shown) is connected to the base 71, while the rotary actuator 61 and rotary support 80 are fixed to the slider 73.

The mover 70 may have any specific form such as a rod cylinder as long as the spray gun 20 is moved along the longitudinal direction of the gun, i.e., in the illustrated example, along the up-and-down direction. The drive source of the mover 70 may also be any type other than the one that uses air as described above, such as an electrical drive source.

The supply controller 50, rotary driver 60, and mover 70 described above share the same air supply source (not shown) as the drive power source. Alternatively, however, separate air supply sources (not shown) may be provided for each of these units.

The container holding unit 90 is arranged to be movable in horizontal directions, configured to hold the container C in a stationary state, and used also in other process steps of the container production line. The container holding unit 90 may have any specific form as long as the container C is held.

Next, one example of an application method of the coating material L using the application apparatus 10 of this embodiment will be described below.

First, the container C to which coating material is to be applied is moved to a position below the spray gun 20, and the spray gun 20 is lowered so as to insert the shaft 21 into the container C.

Next, when the spray nozzle 22 reaches a lowermost position, the spray gun 20 is rotated 360°, and at the same time the coating material L is ejected from the spray nozzle 22.

Next, as the spray gun 20 is lifted, the spray gun 20 is rotated 360° in the opposite direction from the one when the gun was lowered, and at the same time the coating material L is ejected from the spray nozzle 22. The lifting speed of the spray gun 20 as the spray gun 20 moves up is changed in accordance with the shape of the container C so as to apply the coating material L uniformly on the inner surface of the container C.

The embodiment described above is one example of operation of the application apparatus 10 of the present invention. While the application apparatus 10 is oriented vertically, the application apparatus 10 may also be oriented horizontally, and as long as it is disposed along the longitudinal direction of the gun, the application apparatus 10 may be installed in any style.

The application apparatus 10 may be operated in accordance with the shape, size and the like of the container C, with suitable settings such as the speed of the spray gun 20 as it moves down and up, the rotation speed of the spray gun 20, the rotation timing of the spray gun 20, the ejection timing of the coating material L, the rotation angle of the spray gun 20, and the ejection amount of the coating material L, etc.

While the coating material applied to the container described above is a material that improves surface slipperiness for the contents, and the container described above is a container air-tightly packed with a viscous material such as mayonnaise-like food products, the coating material may be of any kind, and the container may be used for any purposes.

Next, an application apparatus 10 according to a second embodiment of the present invention will be described with reference to FIG. 4 and FIG. 5. Since the configuration of the second embodiment is completely the same as that of the previously described first embodiment except for some parts, it will not be described again except for the differences.

In the application apparatus 10 described in the foregoing, when the coating material L is applied in the container C, the coating material L ejected from the spray nozzle 22 is atomized inside the container C. This atomized coating material L may adhere to the upper end edge of the container opening C1 and adversely affect the bonding of a sealing member to the upper end edge of the container opening C1, or, the coating material may adhere to the spray nozzle 22 and adversely affect ejection of the coating material L from the spray nozzle 22. Moreover, whirling jets of atomized coating material L from the container C may contaminate the outer environment, and increased internal pressure may induce deformation of the container, which will make it difficult to achieve a good balance between the application speed of the coating material L and the uniformity of application on the inner wall surface of the container. Therefore, in the application apparatus 10 of the second embodiment, to prevent such circumstances, an airflow augmentation unit 100 is provided as a aspirator that can be positioned opposite the container opening C1 in the longitudinal direction, in the illustrated example, above the container opening C1. Although not shown, a suction duct or the like is provided above or in the vicinity of the airflow augmentation unit 100 as a countermeasure against contamination of the outer environment.

Figure 4:
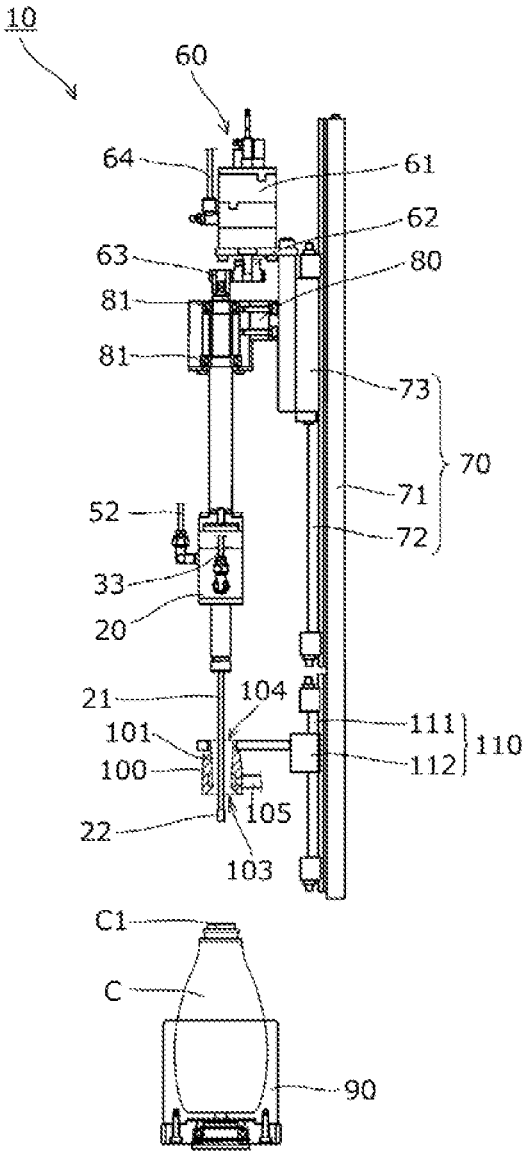
FIG. 4 is a front view illustrating an application apparatus according to a second embodiment of the present invention.
Figure 5:
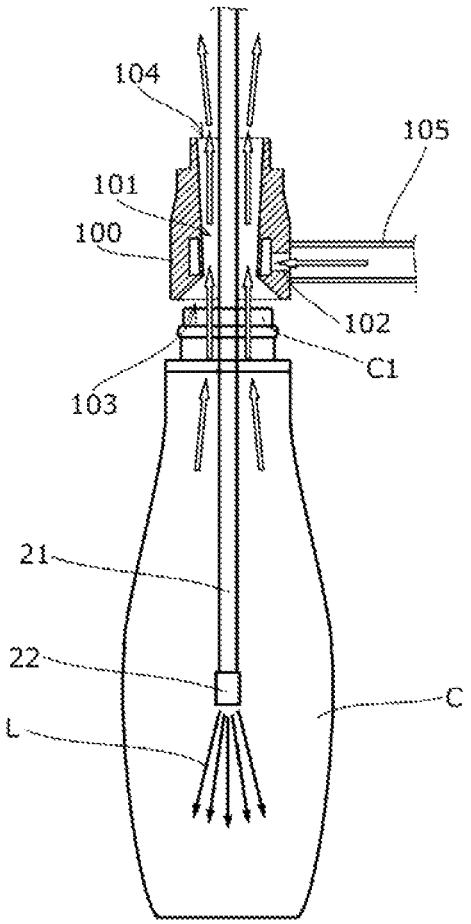
FIG. 5 is a schematic illustrative diagram showing an example of operation of the application apparatus according to the second embodiment.

The airflow augmentation unit 100 is formed substantially cylindrical, and includes a gas supply part 102 connected to an air supply source (not shown) via a gas supply pipe 105, and an airflow augmenting passage 101 having a lower suction port 103 and an upper ejection port 104, as shown in FIG. 4 and FIG. 5, and provides the function of the flow increasing mechanism such as those shown in Japanese Patent Applications Laid-open Nos. H4-184000 and 2006-291941.

More specifically, the airflow augmentation unit 100 has the airflow augmenting passage 101 extending along the longitudinal direction of the gun, in the illustrated example, up-and-down direction, and is disposed such that the shaft 21 of the spray gun 20 is positioned inside the airflow augmenting passage 101. A gas such as air supplied to the gas supply part 102 is ejected along the inner circumference of the airflow augmenting passage 101 toward the ejection port 104 at high speed. By this ejection of gas, the gas containing the coating material L that has been atomized inside the container C is sucked from the suction port 103 positioned above and opposite the container opening C1 and ejected from the ejection port 104 at high speed and high pressure.

The aspirator may have other specific forms that use other principles than the one described above as long as the gas can be sucked from the container opening C1. The gas supplied to the gas supply part 102 may be any gas. Air is more preferable, since the aspirator can then share the same air supply source with other constituent elements (such as the supply controller 50, rotary driver 60, mover 70, second mover 110, etc.).

The airflow augmentation unit 100 is configured to be movable in the up-and-down direction by the second mover 110 as shown in FIG. 4 independently of the movement of the spray gun 20 along the longitudinal direction of the gun, in the illustrated example, up-and-down direction. The second mover 110 is configured as a pneumatic rodless cylinder, and made up of a second linear guide 111 formed on the base 71 in a lower part of the linear guide 72, and a second slider 112 that is configured to be movable along the up-and-down direction and supports the airflow augmentation unit 100. Alternatively, the second mover 110 may not be provided, and the airflow augmentation unit 100 may be disposed fixedly so that it does not move up and down.

Next, an operation example of the application apparatus 10 in the second embodiment will be described. Since the method of applying the coating material L with the use of the spray gun 20 and others is the same as that of the first embodiment, it will not be described in detail.

First, the container C to which the coating material is to be applied is moved to a position below the spray gun 20, after which the shaft 21 of the spray gun 20 is inserted into the container C. At the same time, the airflow augmentation unit 100 is moved down, and stopped at a position where the suction port 103 of the airflow augmenting passage 101 is slightly spaced from the container opening C1.

The distance between the suction port 103 and the container opening C1 should be as small as possible within a range in which the negative pressure created by the suction of the gas from the container C by the airflow augmentation unit 100 does not cause the container C to deform or stick to the suction port 103.

Next, a gas is supplied to the gas supply part 102 so that the gas inside the container C is sucked by the airflow augmentation unit 100, while the coating material L is ejected from the spray nozzle 22 and applied on the inner wall surface of the container C.

The embodiment described above is one example of operation of the application apparatus 10 of the present invention. The timing of moving the airflow augmentation unit 100 to the proximity of the container opening C1, and the timing of sucking the gas from the container C, etc., may be determined suitably.

While the airflow augmentation unit 100 is disposed such that the shaft 21 of the spray gun 20 movable along the up-and-down direction is positioned inside the airflow augmenting passage 101 in the embodiment described above, the spray gun 20 may be moved in the horizontal direction, with its shaft 21 being positioned inside the airflow augmenting passage 101, and the airflow augmentation unit 100 may be installed in any style as long as it is disposed along the longitudinal direction.

The invention claimed is:

1. An application apparatus that applies a coating material on an inner wall surface of a container, comprising:

a spray gun having a spray nozzle and including a coating material ejection passage formed therein;

an outgoing pipe and a return pipe attached to said spray gun and forming a coating material circulatory path connecting to said coating material ejection passage;

a supply controller that controls supply of the coating material from said coating material circulatory path to said coating material ejection passage;

a rotary driver that rotates said spray gun around an axis extending along a longitudinal direction of the gun; and a mover that moves said spray gun along the longitudinal direction of the gun, wherein said spray gun includes, formed therein, said coating material ejection passage connecting to said spray nozzle, and a coating material passage connecting to said coating material ejection passage;

said outgoing pipe and said return pipe each have one end attached to an outer circumferential part of said spray gun that is rotatable so as to connect directly with said coating material passage, and form said coating material circulatory path together with said coating material passage;

said supply controller includes an open/close valve provided between said coating material passage and said coating material ejection passage and is configured to supply the coating material from said coating material passage to said coating material ejection passage by opening and closing said valve;

said outgoing pipe and said return pipe are each provided with a coil-like resilient-shape part capable of extending and contracting resiliently;

said coil-like resilient-shape parts of said outgoing pipe and said return pipe are disposed outside said spray gun so as not to surround said spray gun that is rotatable; and said outgoing pipe and said return pipe rotate with said spray gun.

2. The application apparatus according to claim 1, wherein said rotary driver rotates said spray gun through a predetermined angle in forward and reverse directions.

3. The application apparatus according to claim 1, wherein a rotation angle of the spray gun rotated by said rotary driver is set as at least 180°.

4. The application apparatus according to claim 1, wherein said spray nozzle has a nozzle shape capable of ejecting the coating material so as to spread symmetrically on both right and left sides.

5. The application apparatus according to claim 1, wherein said spray gun is disposed such that the longitudinal direction of the gun coincides with an up-and-down direction.

6. The application apparatus according to claim 1, wherein said supply controller includes an air ejector that supplies air to said spray gun to allow the coating material to be supplied from said coating material circulatory path to said coating material ejection passage, and said rotary driver and said mover each include a pneumatic actuator.

7. The application apparatus according to claim 1, wherein said rotary driver includes a rotary actuator, and a gear interposed between said rotary actuator and said spray gun.

8. The application apparatus according to claim 1, further comprising an aspirator that can be positioned opposite a container opening.

9. The application apparatus according to claim 8, wherein said aspirator includes an airflow augmentation unit, said airflow augmentation unit including an airflow augmenting passage having a gas supply hole, a suction port, and an ejection port, said suction port being disposed opposite the container opening.

10. The application apparatus according to claim 9, wherein said airflow augmentation unit is disposed such that a shaft of said spray gun is positioned inside said airflow augmenting passage.

11. The application apparatus according to claim 9, further comprising a second mover that moves said airflow augmentation unit along the longitudinal direction of the gun.

* * * * *